US008360025B2

(12) United States Patent
Newman et al.

(10) Patent No.: US 8,360,025 B2
(45) Date of Patent: Jan. 29, 2013

(54) INTAKE MANIFOLD WITH OVERMOLDED STRUCTURAL ENHANCEMENT

(75) Inventors: Chris William Newman, Farmington Hills, MI (US); Mohammad Ali Moetakef, West Bloomfield, MI (US); Christopher Snow, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 493 days.

(21) Appl. No.: 12/759,989

(22) Filed: Apr. 14, 2010

(65) Prior Publication Data

US 2011/0253080 A1 Oct. 20, 2011

(51) Int. Cl.
*F02M 35/10* (2006.01)

(52) U.S. Cl. ..... 123/184.61; 123/184.31

(58) Field of Classification Search ..... 123/184.61
See application file for complete search history.

(56) References Cited

U.S. PATENT DOCUMENTS

| | | | |
|---|---|---|---|
| 5,580,122 | A | 12/1996 | Muehlhausen |
| 6,732,712 | B2 | 5/2004 | Klotz et al. |
| 6,782,862 | B2 | 8/2004 | Homi |
| 6,802,293 | B2 | 10/2004 | Iwata et al. |
| 6,844,037 | B2 | 1/2005 | Gombert et al. |
| 7,059,289 | B2 | 6/2006 | Cunningham et al. |
| 2007/0262486 | A1 | 11/2007 | Waters et al. |
| 2009/0038574 | A1 | 2/2009 | Schlicker et al. |

FOREIGN PATENT DOCUMENTS

| | | |
|---|---|---|
| JP | 60-81457 | 5/1985 |

*Primary Examiner* — Noah Kamen
(74) *Attorney, Agent, or Firm* — Julia Voutyras; Alleman Hall McCoy Russell & Tuttle LLP

(57) ABSTRACT

A composite intake manifold coupled to a V-engine is provided. The composite intake manifold includes a supporting member overmolded in an unsupported region of the composite intake manifold.

20 Claims, 7 Drawing Sheets

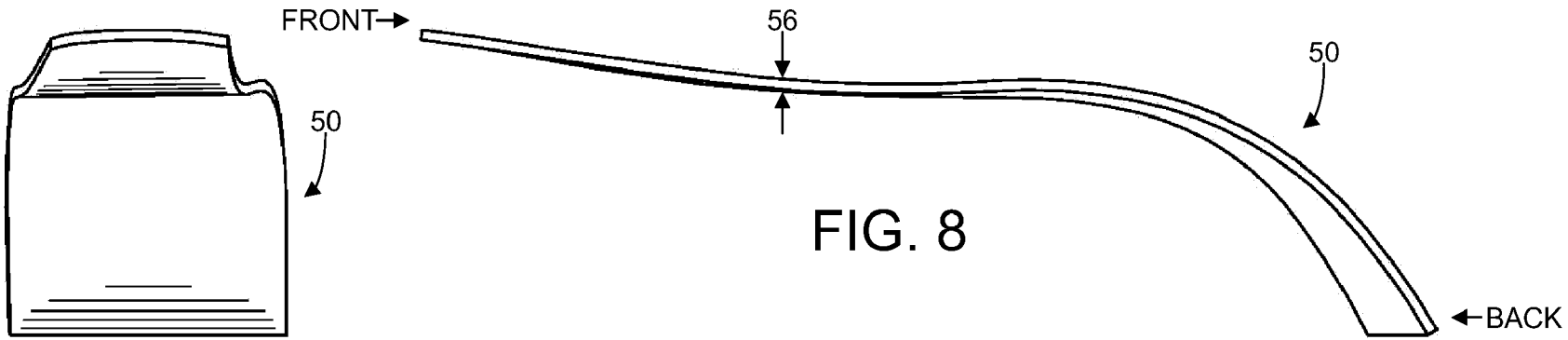
FIG. 8
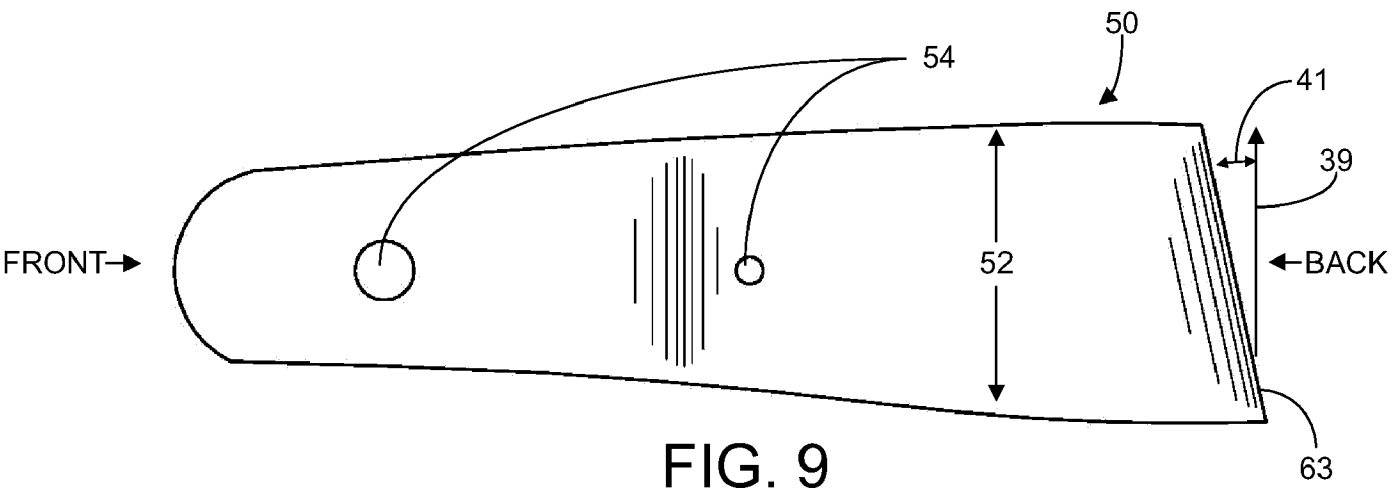
FIG. 9
FIG. 7

INTAKE MANIFOLD WITH OVERMOLDED STRUCTURAL ENHANCEMENT

FIELD

The present invention relates to structural enhancement of a composite intake manifold.

BACKGROUND AND SUMMARY

Intake manifolds coupled to engines, e.g., engines used in the propulsion of vehicles, may be composed at least partially of composite materials including plastics, resins, and/or polymer materials. Such composite intake manifolds are generally not as strong or stiff as manifolds made from metal or ceramic materials, for example. Thus sections of outer walls of such composite intake manifolds may lack sufficient structural support, e.g., to withstand significant internal pressures and accommodate components which may be mounted on the manifold. A section of an outer wall of a composite intake manifold lacking sufficient structural support may contribute to NVH (noise, vibration, harshness), durability, and/or strength problems of the intake manifold. Increasing thickness of the outer walls of a composite manifold or introducing additional structural elements within the hollow body of a composite intake manifold are examples of approaches aimed at enhancing structural integrity of composite intake manifolds.

However, the inventors herein have recognized issues with such approaches. For example, increasing the thickness of the outer walls of a composite intake manifold may increase the weight of the manifold, especially depending on the location of the increased thickness. Such increased weight may then lead to lower fuel efficiency in an engine used to propel a vehicle. Additionally, introducing structural elements within the hollow body of a composite intake manifold may increase part cost and degrade the air flow performance of the intake manifold.

To at least partially address these issues, a system for a V-engine, is provided. The system comprises, a composite intake manifold having an upper outer wall positioned opposite a plurality of air outlets of the manifold; and a supporting member overmolded in the upper outer wall. In some examples, the composite intake manifold may be substantially composed of a first material and the supporting member may be substantially composed of a second material, where the second material has a greater tensile strength than the first material.

In this way, the structural integrity of a composite intake manifold may be enhanced without increasing the thickness of the outer walls or introducing structural elements within the hollow body of the manifold. Such a manifold may have increased air flow performance, lower material and part cost, and lower weight. Note that the wall thickness may be increased in addition to the overmolded support, if desired.

It should be understood that the background and summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 7 shows a front view of an example supporting member.

FIG. 8 shows a side view of an example supporting member.

FIG. 9 shows a top view of an example supporting member.

DETAILED DESCRIPTION

Figure 1:
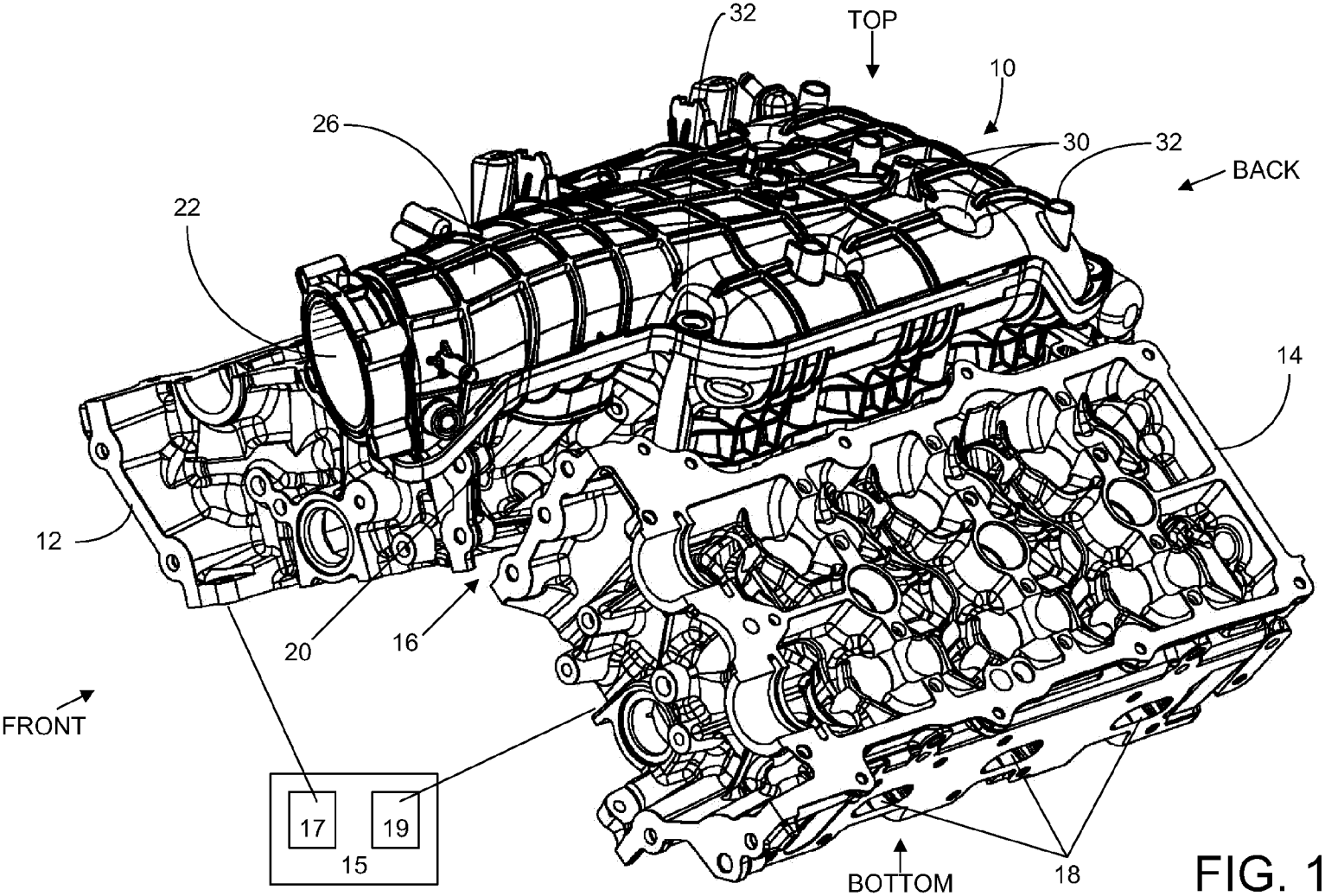
FIG. 1 shows a side view of an example composite intake manifold coupled to a V-engine.
Figure 2:
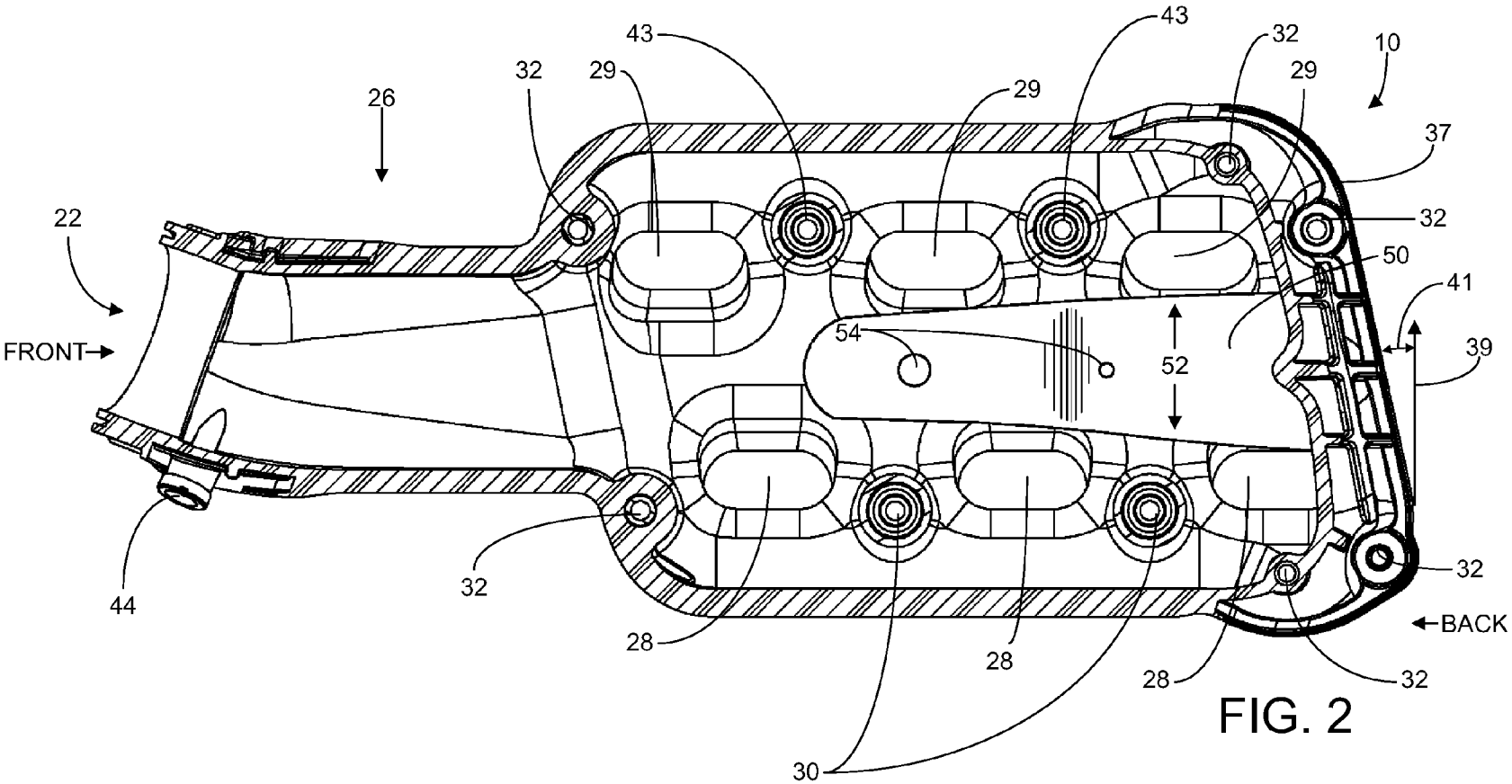
FIG. 2 shows a cutaway top view of an example composite intake manifold with an overmolded supporting member.

The following description relates to composite intake manifolds composed at least partially of plastic or polymer materials. A composite intake manifold may be coupled to cylinder heads of an engine, for example as shown approximately to scale in FIG. 1, to provide air to cylinders of the engine. Such an engine may be used in the propulsion of a vehicle, for example.

Sections of outer walls of a composite intake manifold may lack sufficient structural support, e.g., to withstand significant internal pressures and accommodated components which may be mounted on the manifold. For example, an upper outer wall of the manifold may lack sufficient structural support in a region positioned above and between cylinder heads in a V-engine. Sections of outer walls of the manifold lacking sufficient structural support may contribute to NVH (noise, vibration, harshness), durability, and/or strength problems of the intake manifold.

In order to enhance the structural integrity of a composite intake manifold in an unsupported region of an outer wall of a manifold, a supporting member may be overmolded in said region. FIGS. 2-6 show various views of an example composite intake manifold including a supporting member overmolded in an upper outer wall of the manifold. FIGS. 7-9 show various views of an example supporting member. The figures are shown approximately to scale.

By overmolding a supporting member in an unsupported region of an outer wall of a composite intake manifold, e.g., in an upper outer wall of the manifold between cylinder heads of a V-engine, the structural integrity of the manifold may be enhanced without increasing the thickness of the outer walls or introducing additional structural elements within the hollow body of the manifold. Such a composite intake manifold may have increased air flow performance, lower material and part cost, and lower weight. For example, it may be desirable to minimize a weight of the air intake manifold in order to reduce the weight of a vehicle to thereby increase fuel efficiency.

Turning now to the figures, a composite intake manifold 10 is shown coupled to a first cylinder head 12 and a second cylinder head 14 of a V-engine 15. The first cylinder head is coupled to a first cylinder block 17 of engine 15 and the second cylinder head is coupled to a second cylinder block 19 of engine 15. Intake manifold 10 is positioned on a top side of the engine (labeled "TOP" in FIG. 1) on top surfaces of the cylinder heads. The intake manifold supplies a flow of an air or an air/fuel mixture to cylinders included in the cylinder blocks for combustion. Air enters intake manifold 10 via an air intake conduit 22 integrally coupled to the manifold and adjacent to the front side of the engine (labeled "FRONT" in FIG. 1).

The first and second cylinder blocks and heads form a valley 16 in the V-engine. The valley 16 is an open space beneath the intake manifold which, in some examples, may be used for various engine components, such as air, exhaust, and/or engine coolant conduits. Additionally, open space in the valley may assist in cooling of the engine.

Though not shown in the figures, each cylinder block of the engine includes a plurality of combustion chambers (i.e., cylinders). Each cylinder may include a piston coupled to a crankshaft so that reciprocating motion of the piston is translated into rotational motion of the crankshaft. The crankshaft may be coupled to at least one drive wheel of a vehicle via an intermediate transmission system, for example.

Each cylinder may receive intake air from intake manifold 10 via an intake port located on the cylinder head and may exhaust combustion gases via an exhaust port located on the cylinder head. Thus each cylinder head includes a plurality of exhaust ports and a plurality of intake ports. The exhaust ports are positioned on sides of the cylinders heads opposing the valley 16 in an outbound configuration. For example, outbound exhaust manifolds leading to a tail pipe may be coupled to the exhaust ports on cylinder heads of the banks. A plurality of exhaust ports 18 on cylinder head 14 can be seen in FIG. 1. The intake ports are positioned on the sides of the cylinder heads adjacent to valley 16 in an inbound configuration. An intake port 20 on cylinder head 12 can be seen in FIG. 1.

Composite intake manifold 10 is a generally hollow structure with a hollow body formed at least partially from plastic, resin, and/or polymer materials, e.g., nylon 6, nylon 6/6, or any suitable polyamide. In some examples, intake manifold 10 may be formed at least partially from resin impregnated with a matrix material such a carbon fiber cloth.

The composite intake manifold may be formed as one piece or as multiple pieces joined together in a post-process. For example, one or more pieces of the manifold may be formed using injection molding or blow-molding processes. The one or more pieces of the manifold may be joined together by a suitable welding process, e.g., using a vibration welding technique, and/or by using bolts, gaskets, or other suitable hardware.

Figure 3:
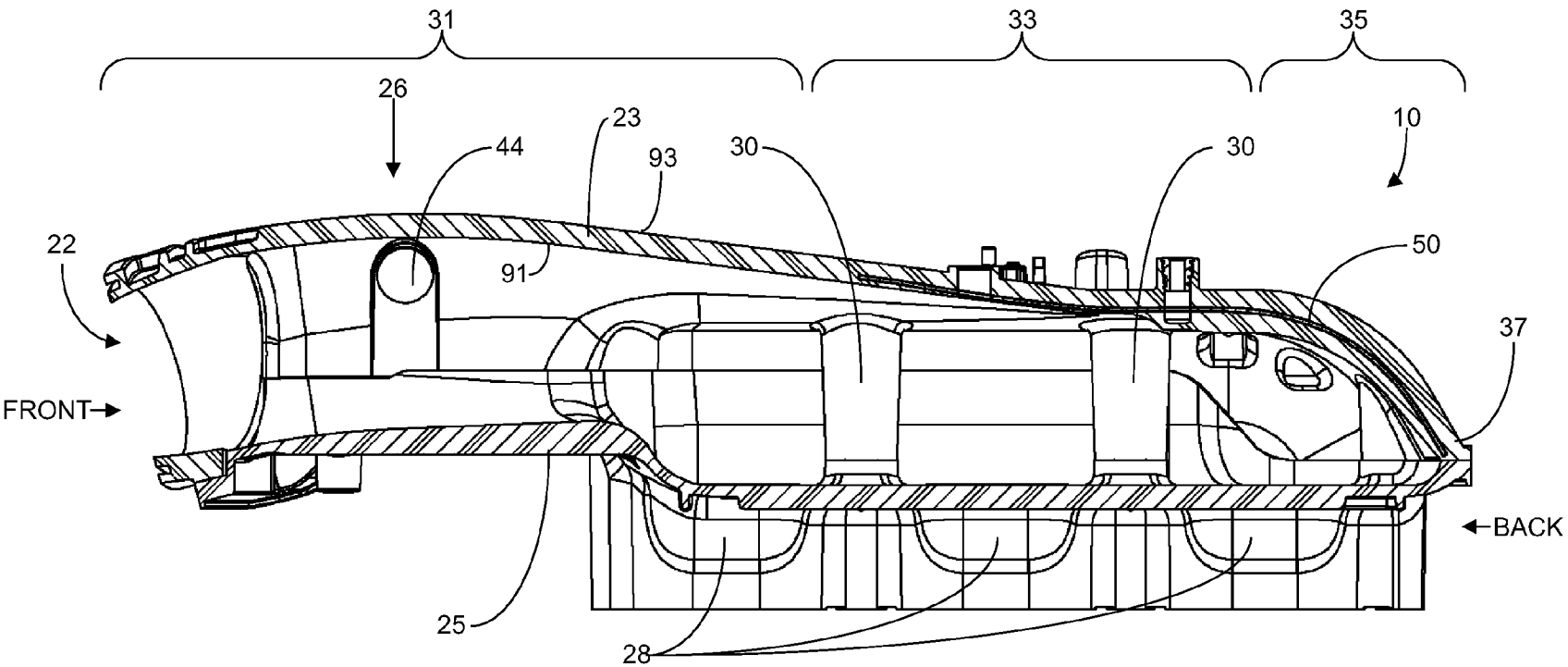
FIG. 3 shows a cutaway side view of an example composite intake manifold with an overmolded supporting member.
Figure 4:
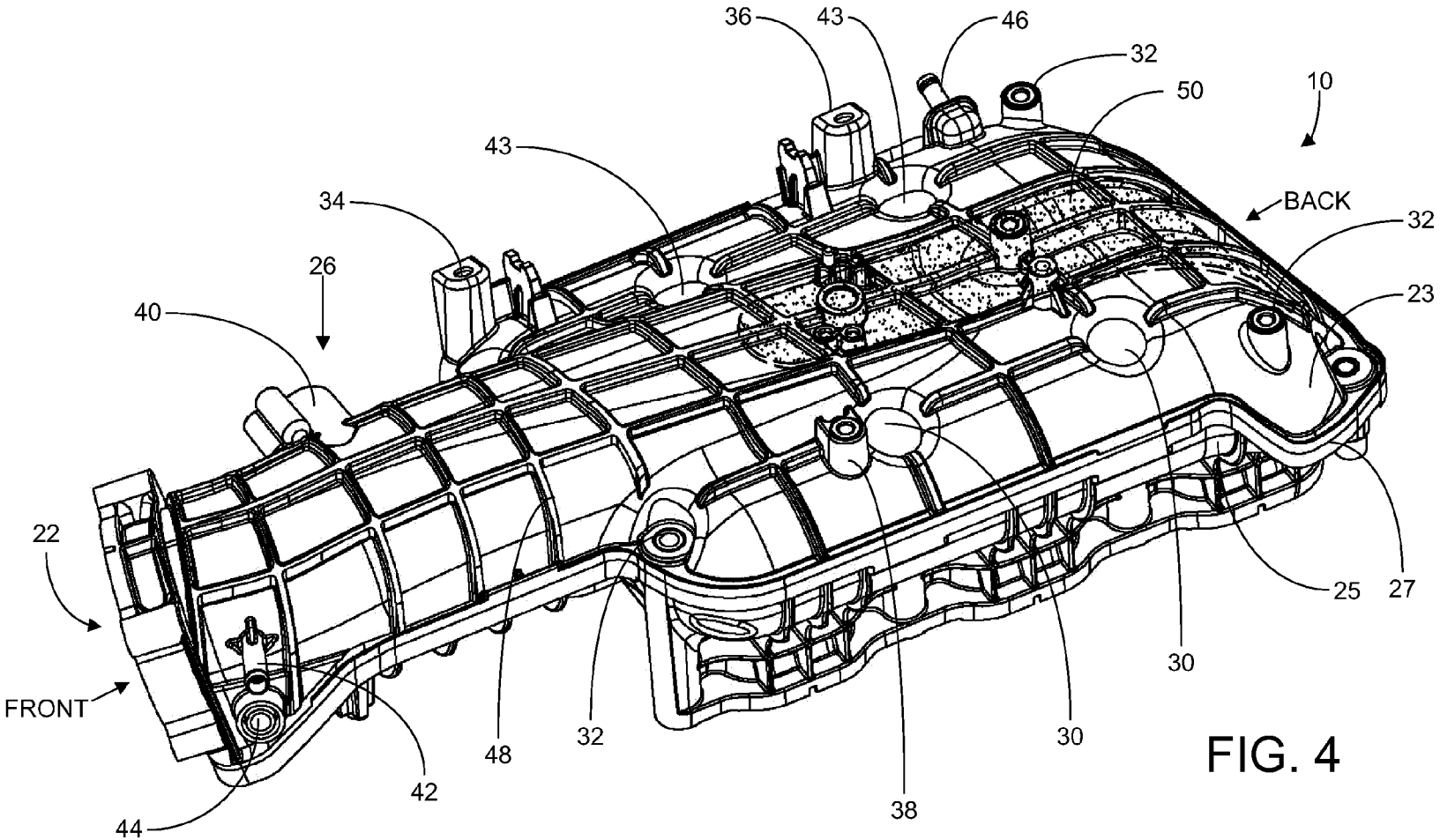
FIG. 4 shows a side view of an example composite intake manifold with an overmolded supporting member.
Figure 5:
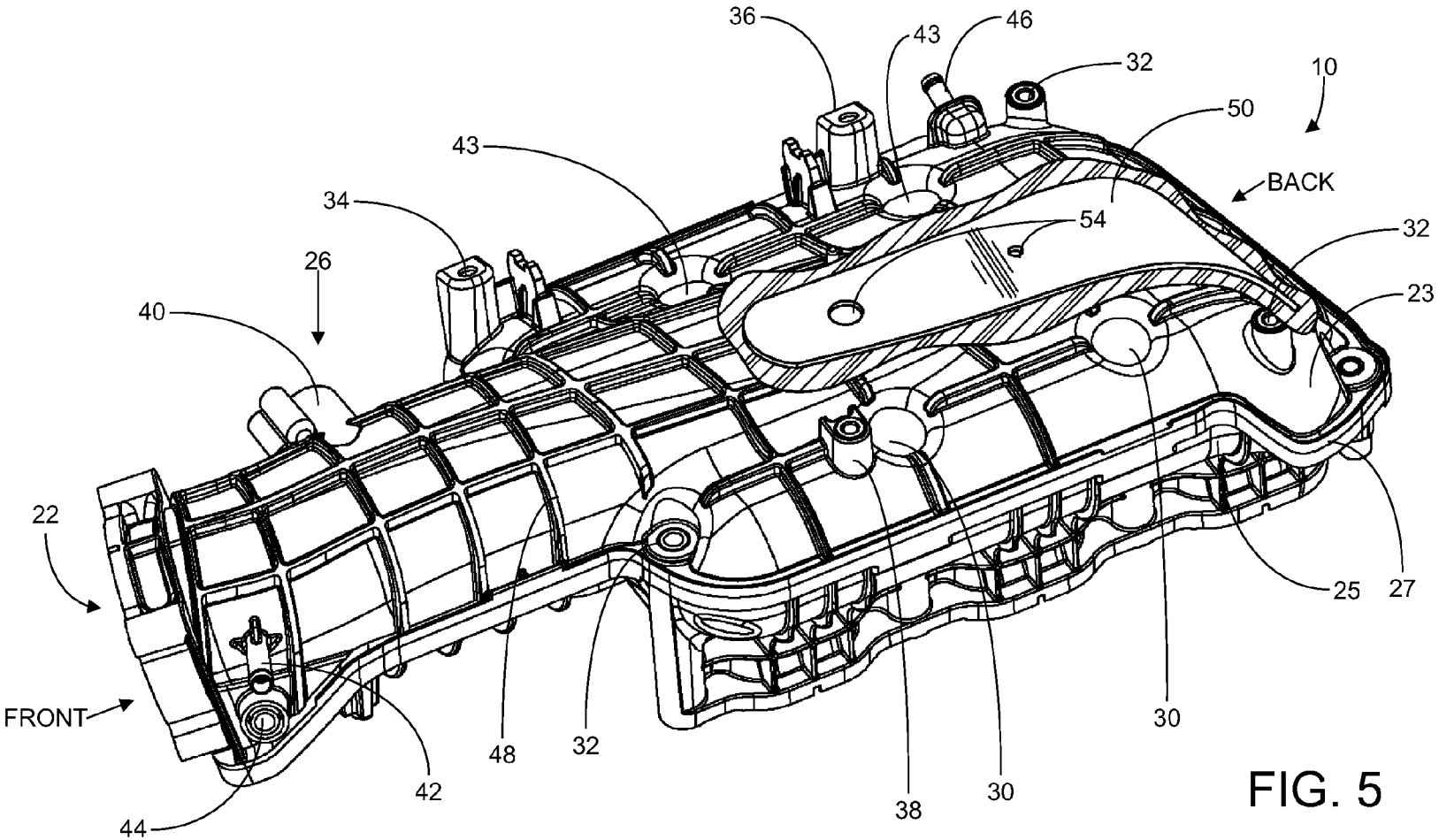
FIG. 5 shows a cutaway side view of an example composite intake manifold with an overmolded supporting member.
Figure 6:
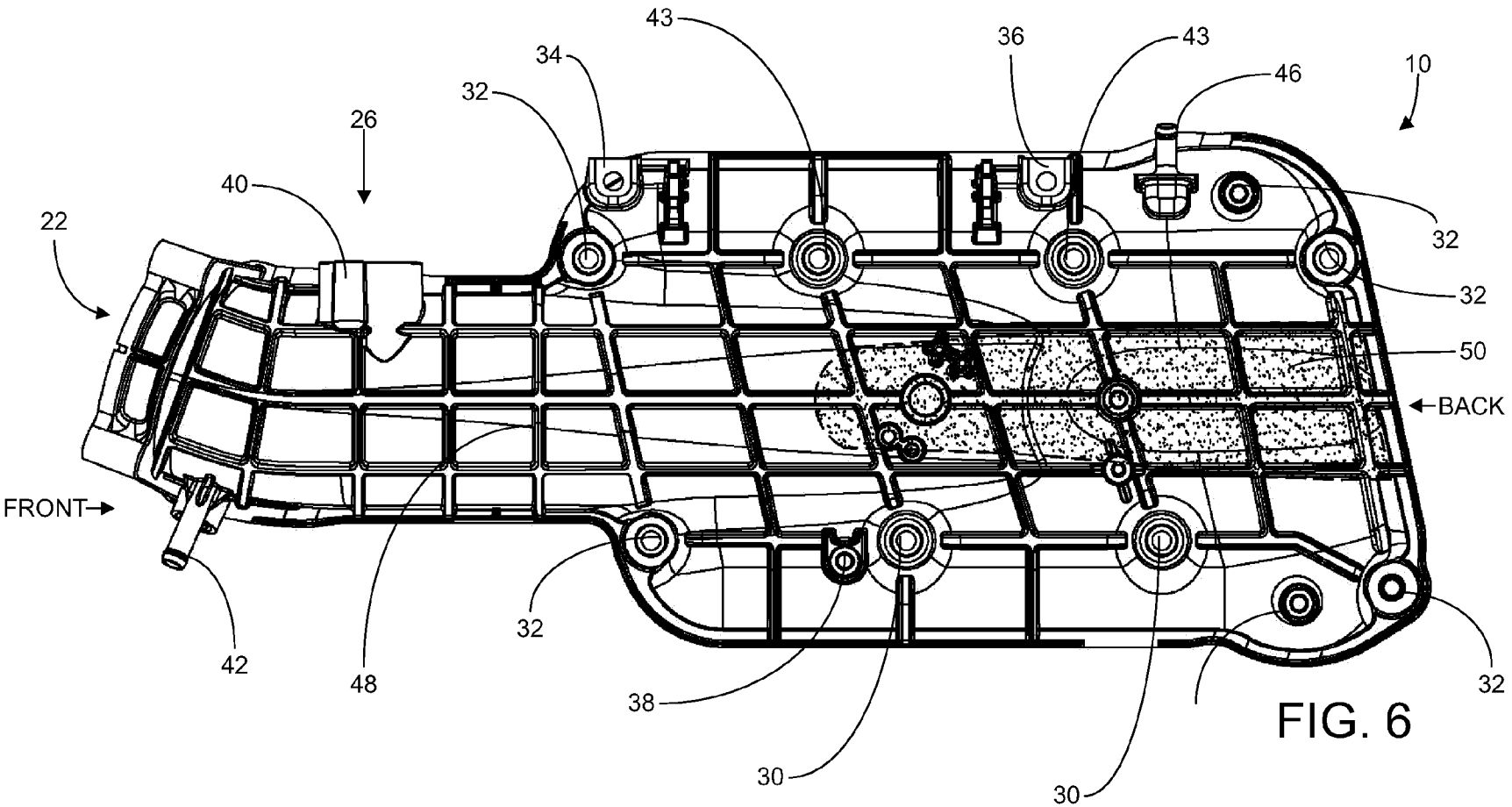
FIG. 6 shows a top view of an example composite intake manifold with an overmolded supporting member.

For example, composite intake manifold 10 shown in FIGS. 3-5 includes an upper outer wall 23 and a lower outer wall 25. The upper outer wall 23 may be directly coupled to the lower outer wall 25 along an edge 27. The upper outer wall may terminate at the edge, and the edge may be supported the lower outer wall. In some examples, the upper and lower outer wall may be joined together by a suitable welding process and/or by bolts, gaskets, or other suitable hardware. The edge 27 may confer structural support to sections of manifold 10 adjacent to the edge.

The hollow body of intake manifold 10 defines a plurality of passages in fluid communication with the manifold. The plurality of passages includes an air intake conduit 22 which is a conduit integrally coupled to the front side of the intake manifold to supply air, e.g., atmospheric air, to the manifold. For example, the upper outer wall and the lower outer wall may form the air intake conduit. Air intake conduit 22 may be positioned in a direction perpendicular to the plurality of air outlets in the lower outer wall of the manifold.

The plurality of passages also includes a plurality of air outlets of the manifold positioned opposite the upper outer wall. For example, the plurality of air outlet may be formed in lower outer wall 25 adjacent to the edge of the manifold. Each air outlet in the plurality of outlets may be coupled to a corresponding intake port on the cylinder heads.

The plurality of air outlets of the manifold includes a first plurality of outlets 28 in the lower outer wall 25 adjacent to a first portion of the edge and coupled to first cylinder head 12 and a second plurality of outlets 29 in the lower outer wall 25 adjacent to a second portion of the edge opposite the first portion, and coupled to the second cylinder head. The first plurality of outlets 28 and the second plurality of outlets 29 can be seen in FIG. 2, which shows a cutaway top view of intake manifold 10.

Each air outlet in the plurality of air outlets may be flanked by support columns adjacent to the edge of intake manifold 10. For example, the intake manifold may include a first plurality of columns 30 integrally coupled to the upper and lower outer walls and flanking air outlets in the first plurality of outlets 28 and a second plurality of columns 43 integrally coupled to the upper and lower outer walls and flanking outlets in the second plurality of outlets. The columns may be cylindrically shaped and substantially hollow to provide structural support to regions of the intake manifold adjacent to the edge of the intake manifold. In some examples, the columns may be integrally molded with upper outer wall 23 of manifold 10. The columns may then be integrally coupled to the lower outer wall using a welding process, for example as described above. The substantially hollow columns may also assist in cooling of air delivered to the cylinders.

Each outlet in the first plurality of outlets 28 may be coupled to a corresponding intake port on the first cylinder head and each outlet in the second plurality of outlets 29 may be coupled to a corresponding intake port on the second cylinder head. In some examples, each outlet in the first plurality of outlets 28 may be offset from the corresponding intake port in a direction toward the intake conduit 22 and each outlet in the second plurality of outlets 29 may be offset from the corresponding intake port in a direction opposing the air intake conduit 22. For example, with reference to FIG. 3, the first plurality of outlets 28 and the second plurality of outlets 29 may be offset from each other in a direction parallel to front and back sides of the manifold. As such, a back side 37 of the manifold may form an angle 39 from a direction 41 perpendicular to the front and back sides of the manifold. The first and second plurality of outlets may be offset from one another in order to assist in delivery of air to the cylinders Intake manifold 10 may be mechanically coupled to the intake ports on the cylinder heads using mechanical fasteners. For example, intake manifold 10 may be attached to the cylinder heads by a plurality of attachments 32 located adjacent to outer edges of intake manifold 10. The manifold outlets 28 may be coupled to the corresponding cylinder intake ports using one or more of compression gaskets, flanges, mechanical fasteners, or the like.

Intake manifold 10 may further include various mounting components, outlets, etc. which may be coupled to various engine sensors, serve as a mounts for engine components, or secure the intake manifold to the engine. For example, a carburetor, throttle body, coolant cross over, fuel injectors and/or other components of the engine may be fastened to the outer walls of intake manifold 10, e.g., via mounting components 34, 36, 38, and 40. As another example, a manifold absolute pressure (MAP) sensor, a mass air flow (MAF) sensor, an air/fuel sensor, and/or other engine diagnostic devices may be coupled to intake manifold 10, e.g., via outlets 42, 44, and 46.

The upper outer wall 23 may have an undulating or curved shaped. For example, with reference to FIG. 3, in a first region 31 of the upper outer wall 23 in a direction from front to back of the manifold, the upper outer wall is convex. In a second region 33 the upper outer wall is concave. In a third region 35 the upper outer wall is convex. Further, the upper outer wall adjacent to the edge 27 may be substantially convex. Additionally, the thickness of the outer wall may vary across the manifold. For example, the upper outer wall of the manifold in the third region 35 may be thicker than the top outer wall of the manifold in the first region 31 and second region 33.

Composite intake manifolds may have lighter weight, be less costly to produce, provide more insulation, and provide more design freedom than intake manifolds made from metal or ceramic materials. For example, intake manifolds made from metal, such as aluminum, steel, etc. may be costly to produce because of both material costs of the metal as well as production costs associated with casting and milling operations used to produce the metal intake manifold.

However, composite or plastic materials are generally not as strong or stiff as metal or ceramic materials. Thus composite manifolds may have NVH (noise, vibration, harshness), durability, and/or strength problems due to lack of sufficient structure in unsupported sections of the manifold's outer walls; for example, in areas where the manifold spans the cylinder heads of an engine.

In some examples, a framework 48 may be integrally molded onto at least a portion of the outer surface of intake manifold 10. Framework 48 may include a plurality of ribs, trusses, or a skeleton covering the manifold and made of the same material as the manifold. For example, the framework may be integrally molded to outer surfaces of the upper and lower outer walls of the manifold. In this way, structural support of the composite intake manifold may be enhanced.

However, even with framework 48, sections of outer walls of a composite intake manifold may lack sufficient structural support. In order to enhance the structural integrity of the composite manifold in regions of the manifold which lack sufficient structural support, a supporting member 50 may be overmolded in an outer wall, e.g., in upper outer wall 23, of the intake manifold such as shown in FIGS. 2-6. Various views of an example supporting member are shown in FIGS. 7-9.

The overmolded supporting member 50 may be composed of a material which has a greater tensile strength than the material that the composite manifold is made of. For example, if the intake manifold is composed of a first material, then the supporting member is composed of a second material, where the second material has a greater tensile strength than the first material. In some examples, the supporting member may be a plate made of metal, e.g., aluminum, magnesium, stainless steel, alloys, etc. In other examples, the supporting member may be a composite plate of a material more rigid, e.g., with greater tensile strength, than the base substrate comprising the intake manifold.

Overmolding the supporting member into the composite manifold may include inserting the supporting member substantially within an outer wall of the manifold, e.g., within upper outer wall 23 traversing from opposite the plurality of air outlets to the edge 27. For example, the supporting member may be fully overmolded in the upper outer wall of the composite intake manifold during the molding process used to produce the manifold. For example, supporting member 50 may be integrally sandwiched between two layers of upper outer wall 23 as shown in FIG. 3.

Supporting member 50 may extend from a back side 37 of edge 27 toward the front of the manifold opposite the plurality of air outlets in the lower outer wall of the manifold. For example, the supporting member may extend from a side of the manifold opposing the air intake conduit 22 toward the air intake conduit. Additionally, the supporting member may be positioned between the first and second plurality of columns and the first plurality of outlets 28 and the second plurality of outlets 29.

In some examples, a region of the supporting member adjacent to the edge 27 opposite the air intake conduit 22, e.g., region 35 shown in FIG. 3 may be substantially equidistant from an outer surface 93 and inner surface 91 of the upper outer wall 23. A region of the supporting member opposite the plurality of air outlets, e.g., region 33 shown in FIG. 3 may be adjacent to the inner surface 91 of the upper outer wall 23. In this way, the support member may be anchored to the back edge 37 of the manifold and thus confer a greater degree of structural support from the back edge of the manifold to a region of the upper outer wall positioned between the first plurality of columns 30 and the second plurality of columns 43.

Further, the supporting member 50 may include a plurality of holes 54 or anchor points which may be used to further secure the supporting member to the intake manifold; thereby increasing the tensile strength conferred by the supporting member to the outer walls of the intake manifold. In some examples, the supporting member may be a lattice or truss type structure in order to decrease weight while still providing structural enhancement.

Supporting member 50 may substantially conform to the shape of the region of the composite intake manifold which includes the supporting member. Thus the supporting member may have a curved or undulating shape. For example, a region of the supporting member adjacent to the edge opposite the air intake conduit, e.g., region 61 shown in FIG. 8, may be substantially convex and a region of the supporting member opposite the plurality of air outlets, e.g., region 59 shown in FIG. 8, may be substantially concave. With reference to FIG. 9, a back side 63 of supporting member 50 may form an angle 39 from a direction 41 perpendicular to the front and back sides of the manifold.

In some examples, a dimension of the supporting member, e.g., the length, width, and/or thickness of the supporting member, may depend on a variety of physical properties of the intake manifold and/or engine. Such physical properties may include the span of the manifold (e.g., the distance between the cylinder heads), choice of material used in producing the intake manifold, engine type (e.g., size, number of cylinders, etc.), and/or other components surrounding and/or attached to the intake manifold.

Additionally, a width 52 of the supporting member may decrease or taper from the back of the supporting member to the front of the supporting member. For example, a width of the supporting member may decreases from a region of the edge 27 opposite the air intake conduit 22 toward the air intake conduit 22. The thickness 56 of the supporting member may be constant, throughout, e.g., the supporting member may be 3 mm thick. However, in some examples, the thickness 56 of the supporting member may vary, e.g., the thickness may decrease from back to front of the supporting member. Additionally, the width of the supporting member may be greater than the thickness of the supporting member by a threshold value. For example, the width may be at least five times the thickness.

By overmolding such a supporting member in the outer walls of a composite intake manifold, the structural integrity of the composite intake manifold may be enhanced without increasing thickness of the outer walls of the manifold or introducing structural elements within the hollow body of the manifold. Such a composite manifold may have increased air flow performance, reduced vibrations, lower material and part cost, and lower weight.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for a V-engine, comprising:

a composite intake manifold having an upper outer wall positioned opposite a plurality of air outlets of the manifold; and a supporting member overmolded in the upper outer wall.

2. The system of claim 1, wherein the outer wall terminates at an edge supported by a lower outer wall, where the member traverses from opposite the plurality of air outlets to the edge.

3. The system of claim 2, wherein the plurality of air outlets includes a first plurality of outlets in the lower outer wall adjacent to a first portion of the edge and a second plurality of outlets in the lower outer wall adjacent to a second portion of the edge opposite the first portion, and a first plurality of columns integrally coupled to the upper and lower outer walls and flanking air outlets in the first plurality of outlets and a second plurality of columns integrally coupled to the upper and lower outer walls and flanking outlets in the second plurality of outlets, the supporting member positioned between the first and second plurality of columns.

4. The system of claim 3, further comprising first and second cylinder heads and wherein the upper outer wall and the lower outer wall form an air intake conduit and wherein each outlet in the first plurality of outlets is coupled to a corresponding intake port on the first cylinder head, each outlet in the first plurality of outlets offset from the corresponding intake port in a direction toward the intake conduit, and wherein each outlet in the second plurality of outlets is coupled to a corresponding intake port on the second cylinder head, each outlet in the second plurality of outlets offset from the corresponding intake port in a direction opposing the intake conduit.

5. The system of claim 1, wherein the composite intake manifold is substantially composed of a first material and the supporting member is substantially composed of a second material, where the second material has a greater tensile strength than the first material.

6. The system of claim 1, wherein the composite intake manifold forms an air intake conduit and the supporting member extends from a side of the manifold opposing the air intake conduit toward the air intake conduit.

7. The system of claim 6, wherein a width of the supporting member decreased in a direction of the supporting member from a side of the manifold opposing the air intake conduit toward the air intake conduit.

8. The V-engine of claim 6, wherein the supporting member substantially composed of a metal.

9. The V-engine of claim 6, wherein the upper outer wall and the lower outer wall, form an air intake conduit, and the supporting member extends from a region of the edge opposite the air intake conduit toward the air intake conduit.

10. The V-engine of claim 9, wherein a region of the supporting member adjacent to the edge opposite the air intake conduit is substantially equidistant from an outer and inner surface of the upper outer wall and a region of the supporting member opposite the plurality of air outlets is adjacent to the inner surface of the upper outer wall.

11. The V-engine of claim 9, wherein a region of the supporting member adjacent to the edge opposite the air intake conduit is substantially convex and a region of the supporting member opposite the plurality of air outlets is substantially concave.

12. The V-engine of claim 9, wherein a width of the supporting member decreases from a region of the edge opposite the air intake conduit toward the air intake conduit.

13. The V-engine of claim 6, wherein the plurality of air outlets includes a first plurality of outlets in the lower outer wall adjacent to a first portion of the edge and coupled to first cylinder head and a second plurality of outlets in the lower outer wall adjacent to a second portion of the edge opposite the first portion, and coupled to the second cylinder head, the supporting member positioned between the first and second plurality of outlets.

14. The V-engine of claim 13, wherein the upper outer wall and the lower outer wall, form an air intake conduit and wherein each outlet in the first plurality of outlets is coupled to a corresponding intake port on the first cylinder head, each outlet in the first plurality of outlets offset from the corresponding intake port in a direction toward the intake conduit, and wherein each outlet in the second plurality of outlets is coupled to a corresponding intake port on the second cylinder head, each outlet in the second plurality of outlets offset from the corresponding intake port in a direction opposing the intake conduit.

15. The V-engine of claim 14, wherein the columns are substantially hollow.

16. The V-engine of claim 13, wherein the intake manifold includes a first plurality of columns integrally coupled to the upper and lower outer walls and flanking air outlets in the first plurality of outlets and a second plurality of columns integrally coupled to the upper and lower outer walls and flanking outlets in the second plurality of outlets.

17. The V-engine of claim 6, wherein the upper and lower outer walls include a framework integrally molded to outer surfaces of the upper and lower outer walls.

18. A V-engine, comprising:

first and second cylinder heads;

a composite intake manifold coupled to the first and second cylinder heads, the composite intake manifold comprising an upper outer wall and a lower outer wall, the upper outer wall positioned opposite a plurality of air outlets of the manifold and directly coupled to the lower outer wall along an edge; and a supporting member overmolded within the upper outer wall, the supporting member traversing from opposite the plurality of air outlets to the edge.

19. A V-engine, comprising:

first and second cylinder heads;

a composite intake manifold coupled to the first and second cylinder heads, the composite intake manifold comprising an upper outer wall, and a lower outer wall, and forming an air intake conduit, the upper outer wall positioned opposite a plurality of air outlets of the manifold and directly coupled to the lower outer wall along an edge; and a supporting member overmolded fully within the upper outer wall, the supporting member extending from a region of the edge opposite the air intake conduit toward the air intake conduit.

20. The V-engine of claim 19, wherein the composite intake manifold is substantially composed of plastic and the supporting member is substantially composed of metal, the intake manifold is bolted at the edges to the first and second cylinder heads, the air intake conduit is positioned in a direction perpendicular to the plurality of air outlets, the upper outer wall adjacent to the edge is substantially convex, a region of the supporting member adjacent to the edge opposite the air intake conduit is substantially convex and substantially equidistant from an outer and inner surface of the upper outer wall and a region of the supporting member opposite the plurality of air outlets is substantially concave and adjacent to the inner surface of the upper outer wall, the plurality of air outlets includes a first plurality of outlets in the lower outer wall adjacent to a first portion of the edge and coupled to first cylinder head and a second plurality of outlets in the lower outer wall adjacent to a second portion of the edge opposite the first portion and coupled to the second cylinder head, the supporting member positioned between the first and second plurality of outlets, the intake manifold includes a first plurality of columns integrally coupled to the upper and lower outer walls and flanking air outlets in the first plurality of outlets and a second plurality of columns integrally coupled to the upper and lower outer walls and flanking outlets in the second plurality of outlets, the first and second plurality of columns adjacent to the edge, the supporting member positioned between the first and second plurality of columns, each outlet in the first plurality of outlets is coupled to a corresponding intake port on the first cylinder head, each outlet in the first plurality of outlets offset from the corresponding intake port in a direction toward the intake conduit, and each outlet in the second plurality of outlets is coupled to a corresponding intake port on the second cylinder head, each outlet in the second plurality of outlets offset from the corresponding intake port in a direction opposing the intake conduit, the upper and lower outer walls include a framework integrally molded to outer surfaces of the upper and lower outer walls, a width of the supporting member decreases from a region of the edge opposite the air intake conduit toward the air intake conduit and the width is at least five times greater than a thickness of the supporting member.

* * * * *